United States Patent [19]

Jentschmann

[11] 4,154,884

[45] May 15, 1979

[54] BINDING TAPE FOR THE EDGES OF CARPETS AND THE LIKE

[76] Inventor: Jakob Jentschmann, Badenerstrasse 575-577, CH-8048 Zurich, Switzerland

[21] Appl. No.: 846,465

[22] Filed: Oct. 28, 1977

[30] Foreign Application Priority Data

Nov. 2, 1976 [CH] Switzerland ..... 13771/76

[51] Int. Cl.[2] ..... B32B 3/02

[52] U.S. Cl. ..... 428/193; 112/418; 112/429; 428/292; 428/293; 428/294

[58] Field of Search ..... 428/102, 111, 192, 193, 428/234, 236, 293, 294; 112/418, 419, 429, 441, 435; 139/117, 118, 384, 385, 387

[56] References Cited

U.S. PATENT DOCUMENTS

| | | | |
|---|---|---|---|
| 2,026,222 | 12/1935 | Dixon | 112/419 |
| 3,991,246 | 11/1976 | Schneider | 428/193 |

*Primary Examiner*—James J. Bell

*Attorney, Agent, or Firm*—Pollock, Vande Sande and Priddy

[57] ABSTRACT

A carpet binding tape comprising an inner tape part provided with loose thread pieces lying closely side by side and transversely of the longitudinal section of the inner tape part, the ends of the loose thread pieces being connected with the longitudinal edges of the inner tape part to form an outer tape part.

3 Claims, 6 Drawing Figures

BINDING TAPE FOR THE EDGES OF CARPETS AND THE LIKE

BACKGROUND OF THE INVENTION

1. Field of the Invention

This invention relates to binding tape for the edges of carpets and the like.

2. Description of the Prior Art

The machines offered at present on the market for reinforcing carpet edges are known in technical circles as carpet whipping machines. These machines work according to the system of the production of an oversewn seam, in that a carpet edge is bound in with a woollen or cotton thread in stitches going to and fro transversely of the edge, with thread pieces lying closely side by side. These whipping machines work with a stout needle, and to produce the thread pieces lying closely side by side a correspondingly small stitch distance must be used. The close succession of needle stitches produces a perforation of the workpiece and the danger of breaking away of the edge perforated by the seam. Moreover the seam image produced by these whipping machines, according to the quality of the transport system of the machine, is subject to great variations when the workpiece is braked or drawn. On pushing forward or pulling of the workpiece wider stitches occur, so that the thread pieces lie too far apart, while on braking of the workpiece the stitches become shorter so that the thread pieces sometimes come to lie one above the other. It was endeavoured to remedy this drawback by additionally permitting a linen strip to accompany, or by sticking a linen strip on, the rubber side along the carpet edge. These remedial measures are always necessary when the carpet is provided with a rubber coating on its under side which is detrimental to the sliding of the workpiece on the machine.

SUMMARY OF THE INVENTION

Now according to the present invention the edges of workpieces are to be reinforced with the use of a binding tape forming the object of the invention, this tape being applied with conventional sewing machines.

The object of the invention is a binding tape for edgings, especially of carpets, felt-type webs, etc., which comprises an inner tape part, the wide side of which is provided with loose thread pieces lying closely side by side and transversely of the longitudinal direction of the tape and forming the outer tape part, the ends of the loose thread pieces being connected with the longitudinal edges of the inner tape part and forming the edge reinforcement together therewith, all in such a way that the inner tape part together with the outer tape part forms a prefabricated whipped seam unit.

DESCRIPTION OF THE PREFERRED EMBODIMENT

The binding tape 1 as illustrated comprises an inner tape part 2 consisting of a fabric, over the wide side of which part an outer tape part 3 is stretched. The outer tape part 3 comprises threads conducted to and fro which form loose thread pieces 3' lying closely side by side and extending transversely of the longitudinal direction of the tape. The ends of the loose thread pieces 3' are connected with the longitudinal edges 4 of the inner tape part 2. The loose thread pieces 3' consist of a piece of single-twisted, relatively coarse thread advantageously of wool yarn type, which is woven with the longitudinal edges 4. The inner tape part 2 together with the outer tape part 3 forms a whipped binding tape serving for edge reinforcement, constituting a prefabricated whipped seam unit.

Figure 1:
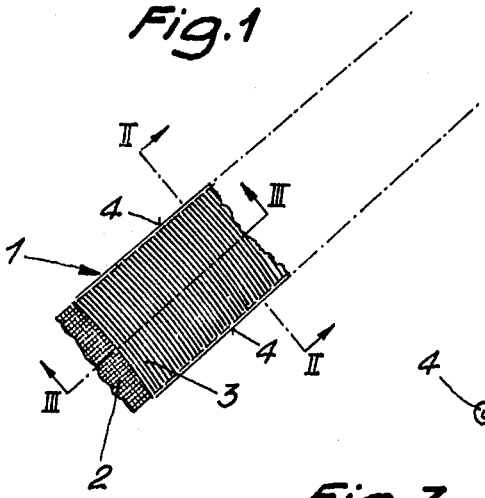
FIG. 1 shows a part of the binding tape seen from the outer tape part side.
Figure 2:
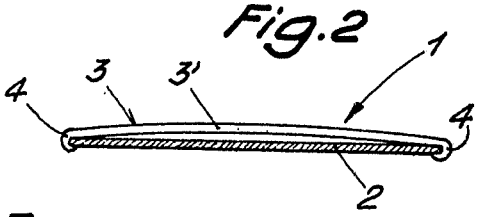
FIG. 2 shows a cross-section along the line II—II in FIG. 1 on a larger scale.
Figure 3:
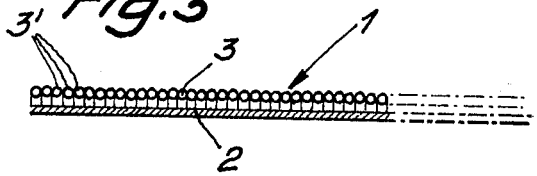
FIG. 3 shows a longitudinal section along the line III—III in FIG. 1 on a larger scale, FIGS. 4 and 5 each show a view of a corner part of a carpet with binding tape.
Figure 5:
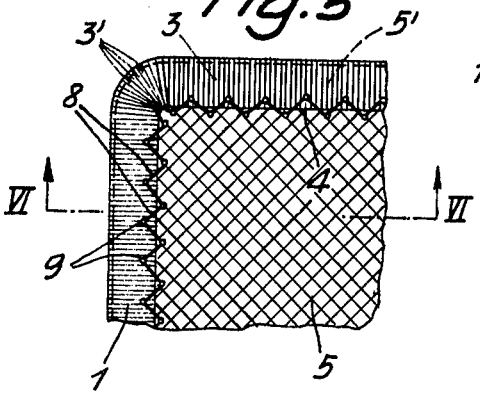
Figure 4:
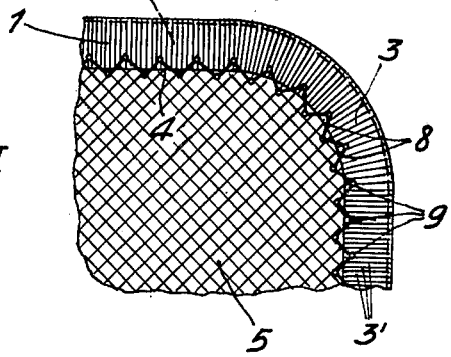
Figure 6:
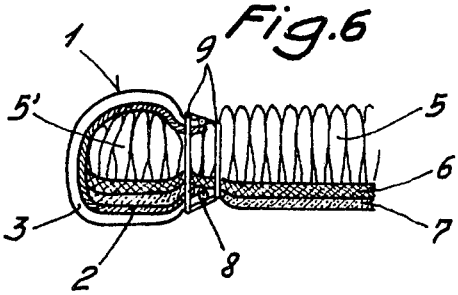
FIG. 6 shows a partial cross-section along the line VI—VI in FIG. 5.

The binding tape 1 as described is expediently sewn with a suitable machine to the edges of carpets, felt-type webs or the like workpieces in wide stitches, preferably zig-zag stitches, by means of transparent nylon thread. FIGS. 4 to 6 show how the binding tape is arranged and secured by means of zig-zag stitches on the edge of a workpiece or carpet. 5 designates the carpet the edge 5' of which is provided with the binding tape 1, sewn on by zig-zag stitches by means of a nylon thread 8, in such a way that the inner tape part 2 abuts on the carpet edge 5' while the outer tape part 3 is visible. 6 is the basic fabric of the carpet 5 and 7 the rubber backing of the under side of the carpet (FIG. 6). The zig-zag seam 8, 9 connecting the binding edge 1 with the carpet edge penetrates the carpet and is hardly visible on its upper and under sides. By reason of the wide zig-zag stitches excessive perforation and thus weakening of the carpet edge are avoided.

In contrast with known proposals, the thread pieces 3' are woven to the longitudinal edges or longitudinal sides of the tape with the floating yarn, which is very advantageous for appearance and strength.

The binding tape can be made in a camouflaging colour so that it is less conspicuous against the bound object, such as carpet, felt-type web, etc., and the whole appears as one unit.

The binding tape as described not only guarantees a secure and durable reinforcement of the edgings of carpets, felt-type webs, felt hats, etc., but also has a decorative effect as a result of the loose thread pieces. Despite the prefabricated unit the thread pieces impart to the binding tape the appearance and effect of so-called whipped seams carried out specially by machine or by hand.

I claim:

1. An elongated binding tape adapted to be attached as a prefabricated unit to the edges of carpets and the like to give said edges the appearance and effect of a whipped seam, said binding tape comprising an elongated strip of fabric forming an inner tape part, an outer tape part attached to said inner tape part in covering relation thereto, said outer tape part comprising a plurality of loose thread pieces lying in side-by-side closely adjacent relation to one another in directions transverse of the longitudinal direction of said fabric strip, said loose thread pieces being free of one another and unattached to said fabric strip except at the opposing ends of said thread pieces, the opposing ends of said thread pieces being interwoven with the edges of said strip of fabric to connect said outer tape part to said inner tape part along only the longitudinal edges of said strip of fabric.

2. Binding tape according to claim 1, secured to the edge of a carpet in covering relation thereto by means of wide zig-zag stitches penetrating the carpet.

3. Binding tape according to claim 2, in which the binding tape is sewn on to the carpet by means of transparent thread.

* * * * *